US005897014A

United States Patent [19]

English

[11] Patent Number: 5,897,014

[45] Date of Patent: Apr. 27, 1999

[54] CLOSER FOR GARBAGE CONTAINER

[76] Inventor: Rich A. English, 7865 Bartmess Dr., Helena, Mont. 59602

[21] Appl. No.: 08/929,233

[22] Filed: Sep. 3, 1997

[51] Int. Cl.[6] ..... B65D 43/26

[52] U.S. Cl. ..... 220/263; 220/335; 220/908; 49/335; 49/337

[58] Field of Search ..... 220/260, 262, 220/263, 264, 335, 334, 908; 217/61, 60 R, 60 F; 49/334, 335, 337, 341, 343

[56] References Cited

U.S. PATENT DOCUMENTS

| | | | |
|---|---|---|---|
| 1,423,817 | 7/1922 | Pitz et al. | 49/343 |
| 2,717,778 | 9/1955 | Christy | 49/343 |
| 2,872,063 | 2/1959 | Lehmann et al. | 220/263 |
| 2,889,068 | 6/1959 | Miller | 220/263 |
| 3,035,829 | 5/1962 | Stotz | 49/341 |
| 3,502,385 | 3/1970 | Stark | 217/60 R |
| 3,545,365 | 12/1970 | Snader | 220/263 X |
| 4,119,238 | 10/1978 | Ali Ja'afar et al. | 220/263 X |
| 4,899,420 | 2/1990 | Bye et al. | 217/60 R |
| 5,367,826 | 11/1994 | Wu | 49/343 |

FOREIGN PATENT DOCUMENTS

| | | | |
|---|---|---|---|
| 1151163 | 5/1969 | United Kingdom | 220/263 |

*Primary Examiner*—Stephen K. Cronin
*Assistant Examiner*—Nathan Newhouse

[57] ABSTRACT

An opening device designed for large sized garbage containers to open the container with a positively controlled opener to provide a safety device to protect persons against accidental closing of very heavy doors or lids on limbs of people who must have access to the inside of the container.

4 Claims, 1 Drawing Sheet

CLOSER FOR GARBAGE CONTAINER

BACKGROUND AND SUMMARY OF THE INVENTION

This invention pertains to safety devices and more particularly to a device for safely opening and closing of large sized containers for garbage or the like.

Use of large sized containers for waste materials such as garbage or waste paper or the like is fairly common particularly for businesses and multiple dwellings. These containers are generally open at the top and are closed by hinged lids formed of heavy gauge sheet metal formed with ribs on corrugations to maintain structural integrity.

The lids are hinged along one edge and can be lifted for the insertion of materials or for removal of the material, but are relatively heavy and often are not easily opened. Further, when the lids are only partially opened, there is considerable danger involved if the opening device should slip and the lid be slammed shut by gravity. This problem is worse when the lid is in the process of being closed.

Accidents caused by accidental closing of such lids have been known to cause loss of limbs, or even a crushing of the body of persons involved in some procedures with the container. Prevention of such accidents is certainly a desired goal.

By the present invention, a positive acting opening and closing mechanism is provided. The device can be adapted to many sizes of containers and is useable on containers for any substance requiring a heavy top lid.

DESCRIPTION

Figure 1:
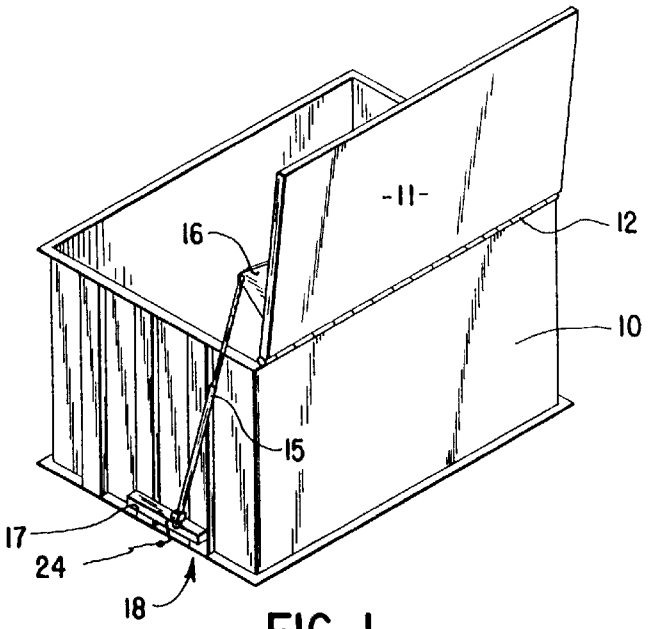
FIG. 1 is a perspective view of a container with a hinged lid and showing the opener in place with the lid opened.
Figure 2:
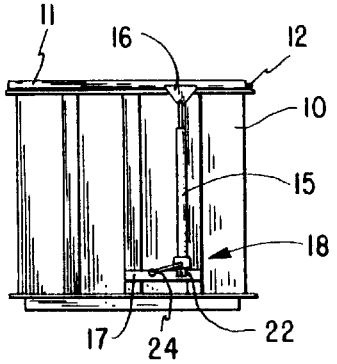
FIG. 2 is an end view of the container and the opener in place with the lid closed.

Briefly this invention comprises a screw threaded, manually operated opener for the lid of a bin. The opener is adapted both to raise and lower the lid by a positive action and thus to prevent accidental closure of the lid.

More specifically, and referring to the drawings, the device is adapted to be used with a bin-like container 10 having a lid 11 hinged to the bin at the one edge 12. The entire assembly is customarily rectangular in plan form and is normally made of steel. Because of the material of the lid, it is relatively heavy. Sometimes the lift to raise the lid is a simple straight, physical lift. More often, a cable and pulley device arranged to pull on a bell crank type lever on the lid may be used. The cable is wound on a winch operated by a crank. In either case, failure to raise the lid completely could and often did result in disaster. With lid weights of somewhere between 350 pounds to 800 pounds, failure was not as uncommon as would be desired. Failures could come from broken cables or from a failure to stop the winch from unwinding. The common result was slamming down of the lid, and if anything such as an arm, finger, or head came between the lid and the bin, the results could range from very painful to fatal. It is obvious that an improved and more safe device is indicated.

The device proposed by this invention comprises an extendable post 15 pivotally attached at one end to a plate 16 fixed to the lid 11. At the lower end, the post is pivotally attached to a bar or plate 17 on the bin. Thus, the post extends between the bin and the lid.

Figure 4:
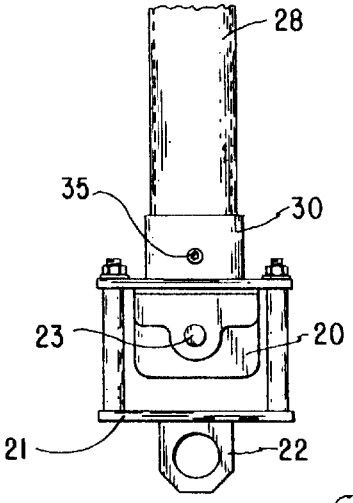
FIG. 4 is a view of the operating end of the closer from a position 90° removed from FIG. 3.
Figure 3:
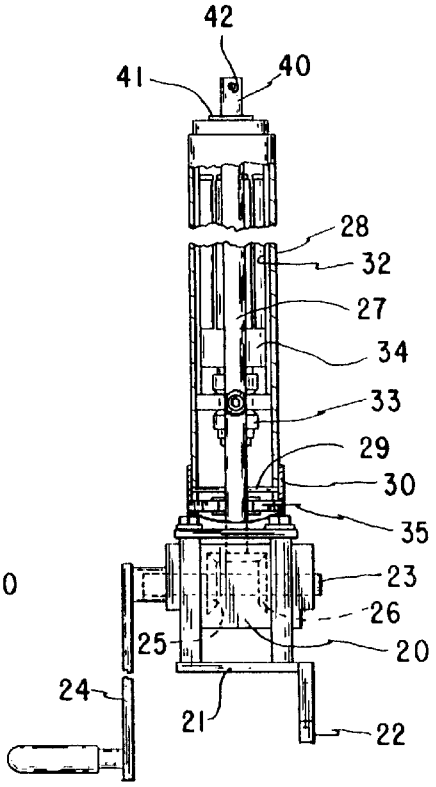
FIG. 3 is a view, partly in section, of the opener mechanism showing internal parts.

Operating means 18 for the extension of the post is provided at a convenient height for the user. The preferred operating devices is illustrated in FIGS. 3 and 4. As shown here, a gear box 20 is bolted to a support bracket 4. This support bracket includes an ear 22 by which the operating mechanism 18 is attached to the plate 17.

The gear box includes a shaft 23 which may be driven by a manual crank 24 or by any convenient power arrangement. Internally a pair of bevel gears 25 provide that movement of the crane 24 is converted into rotation of a longitudinal threaded shaft 27 extending substantially the full length of the post 15 when the post is collapsed. An idler gear 26 journalled on the shaft 23 may be used, as in customary, to balance the horizontal pressure between the gear 25.

That post 15 is, in actuality a telescoping post composed of an outer shell 28 fixed by a rivet 29 in a cup 30 on the gear box 20, and an inner slide 32. The slide 32 includes a threaded nut 33 threaded onto the shaft 29 so that rotation of the shaft will cause movement of the nut 33 and therefore of the slide 32. A slidable bearing 34 surrounding the shaft 27 may serve as a guide. Also, to support the shaft 27, a thrust bearing 35 may be located in the cup 30.

It is now apparent that rotation of the crank 24 will cause the threaded shaft 27 to rotate within the nut 33 and therefore cause the slide 32 to extend beyond the shell 28 or retract into that shell.

A fastening ear 40 is fixed to an outer plug 41 in the slide 32. This ear 40 is pierced by a hole 42 through which a pin or similar device may extend to connect the slide 32 pivotally to the plate 16 on the cover of the container 10.

It will now be apparent that the extension and retraction of the slide 32 as noted above will be effective to push and pull the plate 16 and therefore the lid 11. This action is effective to open and close the lid 11. It will also be seen that the position of the lid 11 will be controlled by the position of the slide 32 and therefore by the screw threaded shaft 27. The screw threaded relationship between the shaft 27 and the nut 33 thus results in a positive holding action. Therefore, by controlling the position of the lid 11 in open or partly open position, any accidental slamming of the lid to a closed position trapping a person between the lid 11 and the container 10 will be avoided.

I claim:

1. A bin comprising a container having a bottom wall, side walls extending upwardly from said bottom wall, each side wall having an upper edge, and an open upper end surrounded by said edges, a lid hinged to said container at one of said edges, and a position control means including an extendible post extending between said container and said lid for raising and lowering said lid and to hold said lid in a partially raised and lowered position, said post including screw threaded operating means having a driven screw threaded shaft engaged with an interiorly threaded nut to cause the extension of said post.

2. The combination of claim 1 in which the extendible post includes a telescoping post having an outer shell and an interior slide telescopingly disposed within said shell, said screw threaded operating means connected between said shell and said slide extending and retracting said post in a controlled manner.

3. The combination of claim 2 in which said screw threaded shaft extends longitudinally within said post, an interiorly threaded nut fixed to said slide and threadably engaged with said shaft, bearing means in said slide to hold said shaft, thrust bearing means in said shell to control the position of said shaft, and rotating operating means connected to said shaft to rotate said shaft in either direction to control the position of said threaded nut and therefore of said slide.

4. The combination claim 3 in which said rotating operating means includes a crank whereby said shaft may be turned.

* * * * *